US010561214B2

(12) United States Patent
Soued et al.

(10) Patent No.: US 10,561,214 B2
(45) Date of Patent: Feb. 18, 2020

(54) COLLAPSIBLE STORAGE CONTAINER

(71) Applicants: Mark Robert Soued, Towaco, NJ (US); Debra Ann Fong, Towaco, NJ (US)

(72) Inventors: Mark Robert Soued, Towaco, NJ (US); Debra Ann Fong, Towaco, NJ (US)

( * ) Notice: Subject to any disclaimer, the term of this patent is extended or adjusted under 35 U.S.C. 154(b) by 113 days.

(21) Appl. No.: 15/808,216

(22) Filed: Nov. 9, 2017

(65) Prior Publication Data

US 2019/0133278 A1 May 9, 2019

(51) Int. Cl.

| | |
|---|---|
| ***A45C 13/02*** | (2006.01) |
| ***A45C 3/06*** | (2006.01) |
| ***A45C 13/10*** | (2006.01) |
| ***A45C 11/38*** | (2006.01) |
| ***A45C 7/00*** | (2006.01) |

(52) U.S. Cl.

CPC ..... *A45C 13/02* (2013.01); *A45C 3/06* (2013.01); *A45C 7/0036* (2013.01); *A45C 11/38* (2013.01); *A45C 13/10* (2013.01); *A45C 2013/026* (2013.01)

(58) Field of Classification Search

CPC ..... A45C 11/38; A45C 3/06; A45C 13/02; A45C 7/0036

USPC ..... 150/113; 16/225; 190/110; 220/520, 220/528; 206/316.2

See application file for complete search history.

(56) References Cited

U.S. PATENT DOCUMENTS

| | | | | | |
|---|---|---|---|---|---|
| 2,624,385 | A | * | 1/1953 | Hogan | A45C 13/02 150/113 |
| 2,657,726 | A | | 11/1953 | Silverman | |
| 3,347,299 | A | * | 10/1967 | Alexander | A45C 3/06 150/106 |
| 4,142,564 | A | | 3/1979 | Zoland | |
| 4,260,004 | A | | 4/1981 | Domke | |
| 4,403,638 | A | * | 9/1983 | Baum | A45C 11/38 206/316.2 |
| 4,542,826 | A | * | 9/1985 | Adams | B65F 1/1463 206/427 |
| 5,356,004 | A | | 10/1994 | Weinreb | |

(Continued)

OTHER PUBLICATIONS

International Search Report and Written Opinion dated Dec. 21, 2018 in corresponding International Application No. PCT/US2018/056432; 11 pages.

(Continued)

*Primary Examiner* — Sue A Weaver
(74) *Attorney, Agent, or Firm* — Maier & Maier, PLLC

(57) ABSTRACT

A collapsible storage container that is insertable into a handbag and which may be used to retain a camera and one or more camera accessories so as to protect the camera, accessories, or any other such items. The collapsible storage container includes a bottom, a front, a back side and dividers disposed between the front side and the back side. The bottom side piece and the divider pieces have a unidirectional grooved channel disposed along the length of the pieces so that the pieces are folded in half in one direction to permit the storage container to collapse flat, with the dividers being sandwiched between the front and back sides. Optionally, the collapsible storage container may have one or more pockets for other items, and may have a flap-top cover extensible over the top of the collapsible storage container.

19 Claims, 19 Drawing Sheets

(56) References Cited

U.S. PATENT DOCUMENTS

| | | | | |
|---|---|---|---|---|
| 5,791,481 | A * | 8/1998 | Thomas | B65D 25/04 206/581 |
| 6,021,895 | A * | 2/2000 | Wu | A63B 55/40 206/315.3 |
| 6,446,688 | B1 | 9/2002 | Sutton | |
| 6,910,560 | B2 * | 6/2005 | Dulin | A45C 3/00 150/112 |
| 7,854,317 | B1 | 12/2010 | Hebert et al. | |
| 8,662,368 | B2 | 3/2014 | Elliott | |
| D708,842 | S | 7/2014 | Hebert et al. | |
| 2010/0071814 | A1 * | 3/2010 | Crandall | A45C 11/38 150/113 |
| 2014/0124550 | A1 | 5/2014 | Blackwell et al. | |
| 2015/0067983 | A1 * | 3/2015 | Carey | B29C 48/09 16/225 |
| 2015/0068933 | A1 | 3/2015 | So et al. | |
| 2015/0125096 | A1 | 5/2015 | Mulholland | |
| 2015/0136785 | A1 | 5/2015 | Tso et al. | |
| 2015/0246751 | A1 | 9/2015 | Spivack et al. | |
| 2016/0145919 | A1 * | 5/2016 | Howell | E05D 1/02 16/225 |

OTHER PUBLICATIONS

Amazon.com "Autoark Foldable Multi Compartment Fabric Car Truck V . . . " dated Sep. 15, 2017, https://www.amazon.com/Autoark-Foldable-Compartment-Organizer-A.. (8 pages).

Amazon.com: "Premium Quality Auto Trunk Organizer by FORTEM for . . . " dated Sep. 15, 2017, https://www.amazon.com/Premium-Quality-Trunk-Organizer-Fortem/ . . . (8 pages).

* cited by examiner

201

COLLAPSIBLE STORAGE CONTAINER

BACKGROUND

Photography has been significantly growing in popularity as a hobby. The ubiquity of lower-end digital cameras in smartphones has led to millions of people being able to gain experience with the hobby and recognize the shortcomings of the digital cameras they are carrying around in their devices. While many are content to keep using their smartphone cameras, others have been motivated to upgrade to a higher-quality stand-alone camera, even when their professions or other interests would not have pushed them in the direction of photography. Meanwhile, serious and professional photographers already realize the limitations of lower-end cameras and continue to use higher-end, larger camera gear.

Stand-alone digital and film cameras on the market today are expensive, fragile, and often need to be retrieved at a moment's notice when the photographer happens across something they think is worthy of a shot. This usually necessitates that the camera be carried in some kind of dedicated protective container or bag, which provides padding and protection to the camera as well as allowing for easy retrieval.

Existing camera bags on the market are mainly functional, providing the standard padding and protection needed for camera gear. However, there is a fundamental lack of "fashionable" camera bags (especially for women) that provide the necessary camera gear protection on the inside, while looking fashionable on the outside and being simple and convenient to use on a regular basis. This can dissuade many hobbyists, and even serious photographers also interested in being stylish, from engaging in photography as much as they would like to, if they are unable to protect their camera in a bag that they would prefer to carry.

There are a number of "inserts" on the market today that can be inserted into an existing handbag or other bag in order to provide protection for a camera and allow for a greater choice of bags. However, each of these inserts has several notable downsides. First, each of these inserts relies on very thick foam cushioning in order to provide adequate protection for the camera and lenses or attachments to be provided with the camera, which creates unnecessary bulk within the bag that usually renders it unsuitable for other purposes (such as carrying other items) and can distort the features of the bag, reducing its aesthetic value. Second, each of these inserts relies on using Velcro to attach the dividers so as to allow the dividers to be customized to many different sizes of bag; the use of Velcro also can make the bag unsuitable for other purposes, as exposed Velcro can catch on certain items that might commonly be disposed within a handbag. For example, if a woven scarf is placed within a handbag, the exposed Velcro can easily catch on the fabric and can create pulls, or can even completely ruin the fabric. Third, each of these existing inserts tends to suffer from the downside that there is no simple way to collapse, store, or pack the unit when not in use. Existing inserts are designed to be rigid, or (when foldable) require that the unit be disassembled into multiple pieces. For example, some existing inserts may require that the Velcro dividers be detached and that other snaps or mechanisms provided with the insert be undone in order to allow the unit to be folded. This is not convenient for the user, as pieces can be lost or go missing when the insert is removed from the bag (reducing the functionality of the insert or preventing it from functioning), or, if the insert is left within the bag when collapsed, the closures, snaps, or Velcro provided on parts of the insert to connect it to other parts of the insert can damage the internal contents of the bag.

SUMMARY

Exemplary embodiments described herein generally relate to a collapsible storage container, and, more specifically, to a collapsible storage container which collapses flat, and is inserted into a handbag to contain a camera and camera lenses, as well as any other articles that it may be desired to carry in a handbag.

Such a collapsible storage container may include: a bottom side which has a unidirectional grooved channel disposed along the length of the bottom side so that the bottom side is folded in half in one direction; a front side; a back side; and dividers which are disposed between the front side and the back side. According to an exemplary embodiment, each divider also has a unidirectional grooved channel disposed along the length of the divider so that the divider is folded in half in one direction.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to the Figures, a collapsible storage container is described. According to exemplary embodiments, the storage container may collapse flat, and the collapsible storage container may be inserted into a handbag containing camera and camera lenses (or other articles) in such a manner as to allow the handbag to optionally carry other articles such as may be desired. In an exemplary embodiment, the collapsible storage container may be configured such that no bare connectors (such as Velcro material or other such connectors) are exposed to any remaining contents of the bag, which may prevent damage to those articles caused by the bare connectors of the collapsible storage container. Further, according to an exemplary embodiment, the collapsible storage container may be configured so that it may be simply expanded or contracted using gravity alone when inserted into a handbag, and may be configured so that the collapsible storage container may be simply collapsed or flattened and removed when not in use by lifting the container from the bag using light pressure.

Figure 1A:
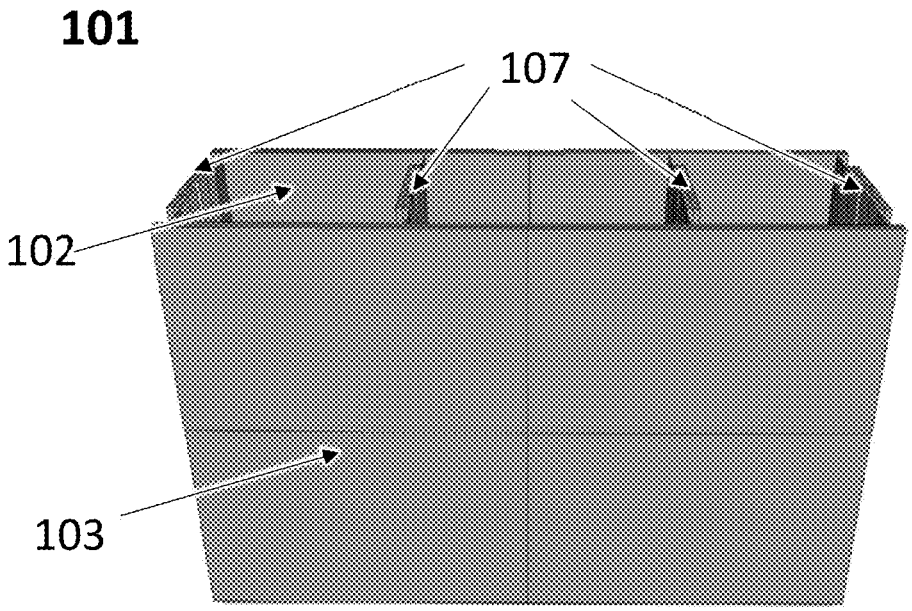
FIG. 1A is a top-front view of an exemplary embodiment of a collapsible storage container.
Figure 1B:
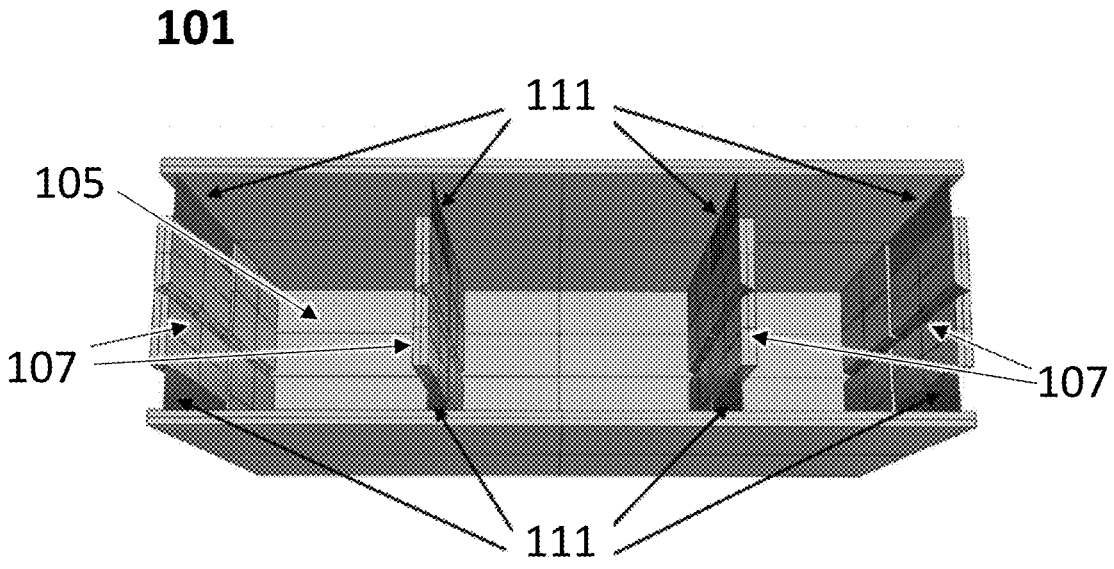
FIG. 1B is a top view of an exemplary embodiment of the collapsible storage container.

Turning now to exemplary FIGS. 1A and 1B, FIG. 1A may show a top-front view of a collapsible storage container, and FIG. 1B may show a top view of the collapsible storage container. According to an exemplary embodiment, the collapsible storage container 101 may include a bottom 105, a front 103, a back side 102 and dividers 107 disposed between the front side 103 and the back side 102. Also, in an exemplary embodiment, the bottom side 105 and each divider 107 may be connected to the back side 102 and the front side 103 via a hinge. According to another exemplary embodiment, an upper half of each divider 107 may be connected to the back side 102 and the front side 103 with an elastic hinge 111 for flexibility, and a lower half of each divider 107 may be connected to the back side 102 and the front side 103 with a fixed hinge for durability.

Figure 1C:
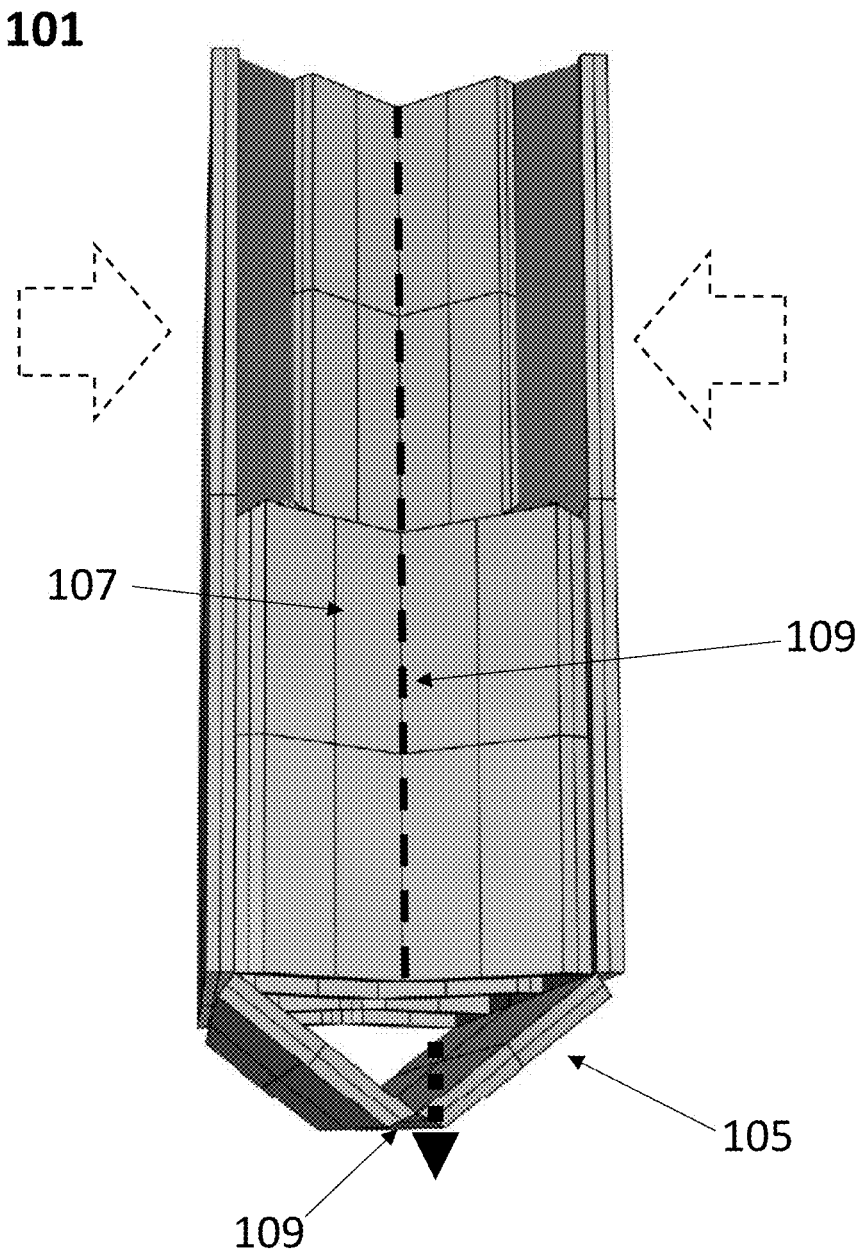
FIG. 1C is a side view of an exemplary embodiment of the collapsible storage container which is partially collapsed.

Turning now to exemplary FIG. 1C, FIG. 1C may show a side view of an exemplary embodiment of the collapsible storage container which is partially collapsed. According to an exemplary embodiment, the bottom side 105 piece and the pieces of divider 107 may have a unidirectional grooved channel 109 disposed along the length of the pieces so that the pieces are folded in half in one direction to permit the storage container 101 to collapse flat.

Figure 1D:
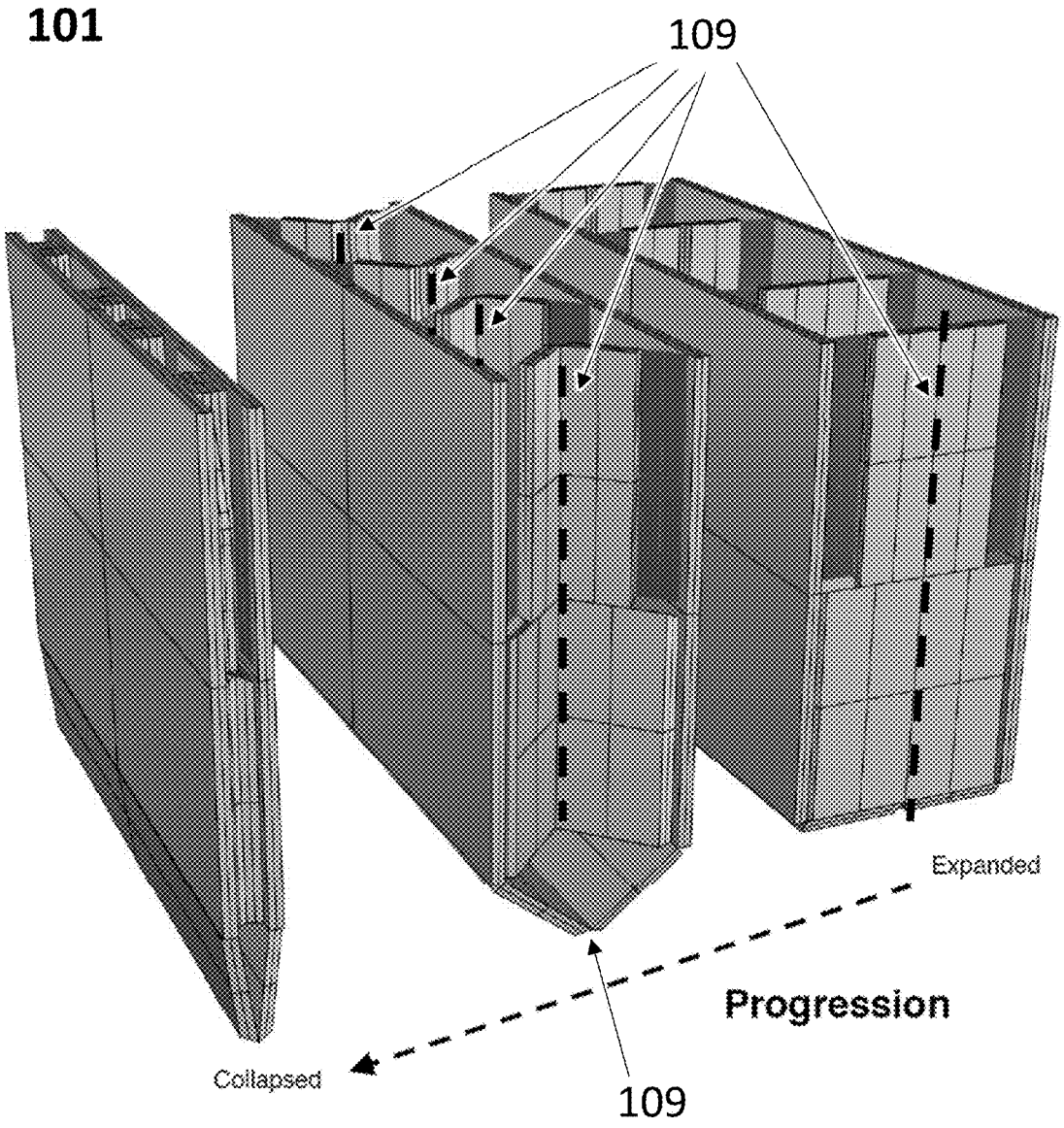
FIG. 1D is a side view of an exemplary embodiment of the collapsible storage container which shows a progression of the collapsing.
Figure 1E:
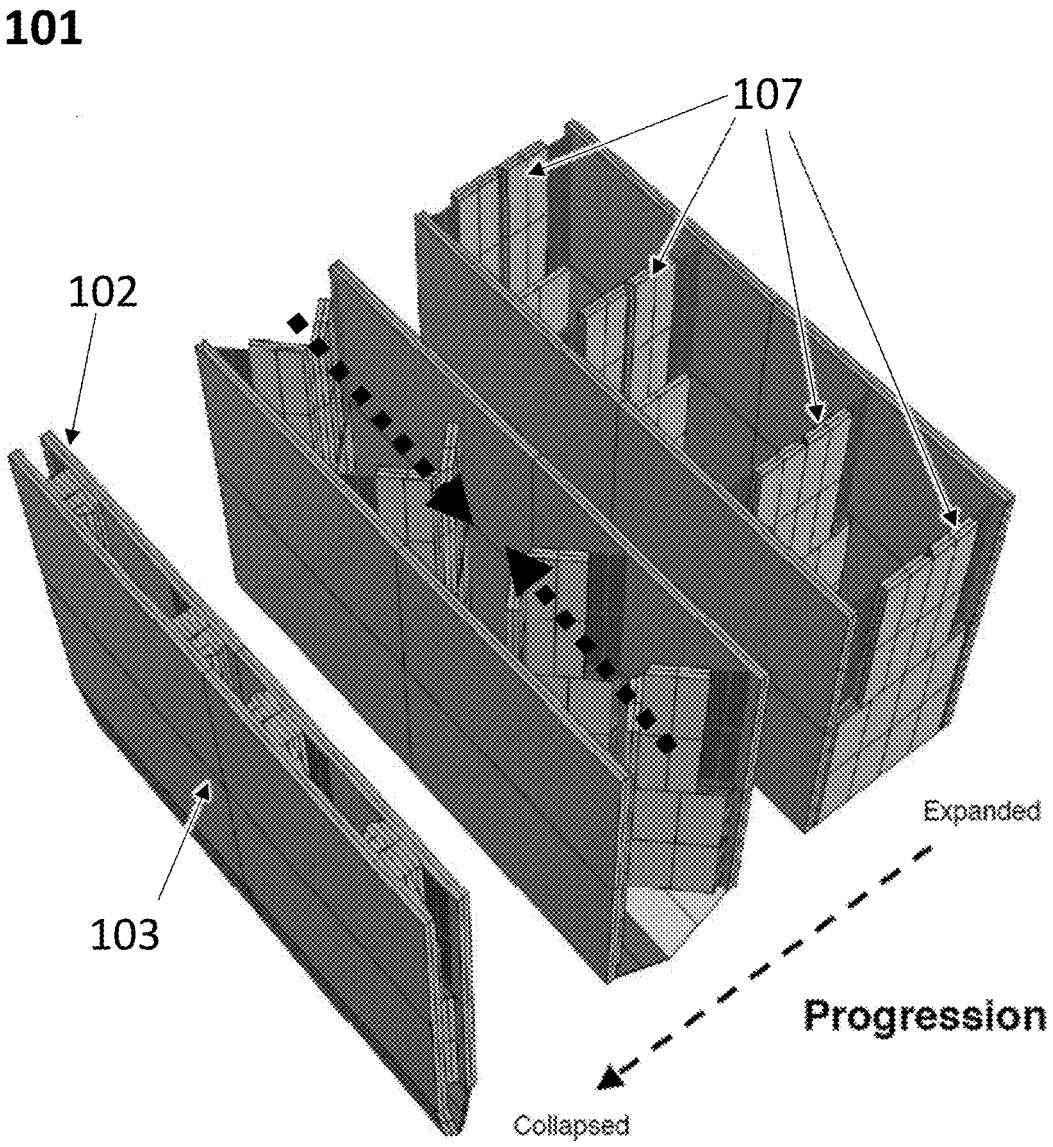
FIG. 1E is a top-side view of an exemplary embodiment of the collapsible storage container which shows a progression of the collapsing.

Turning now to exemplary FIGS. 1D and 1E, FIG. 1D may show a side view of the collapsible storage container, and FIG. 1E may show a top-side view of the collapsible storage container, which describe a progression of the collapsing. According to an exemplary embodiment, as described above, the bottom side 105 piece and the pieces of divider 107 may be folded in one direction via the unidirectional grooved channel 109, with the dividers 107 being sandwiched between the front 103 and back sides 102.

According to an exemplary embodiment, all pieces of the collapsible storage container 101 may be constructed from a protective material such as a thin and high-density foam. Also, in an exemplary embodiment, the piece pads of the collapsible storage container 101 may be covered with a soft material such as rugged fabric. As such, according to an exemplary embodiment, each piece of the collapsible storage container 101 may be formed from, for example, a single piece of thin-high-density foam sandwiched between two layers of rugged fabric, optionally with other layers or components inserted as well.

Figure 2A:
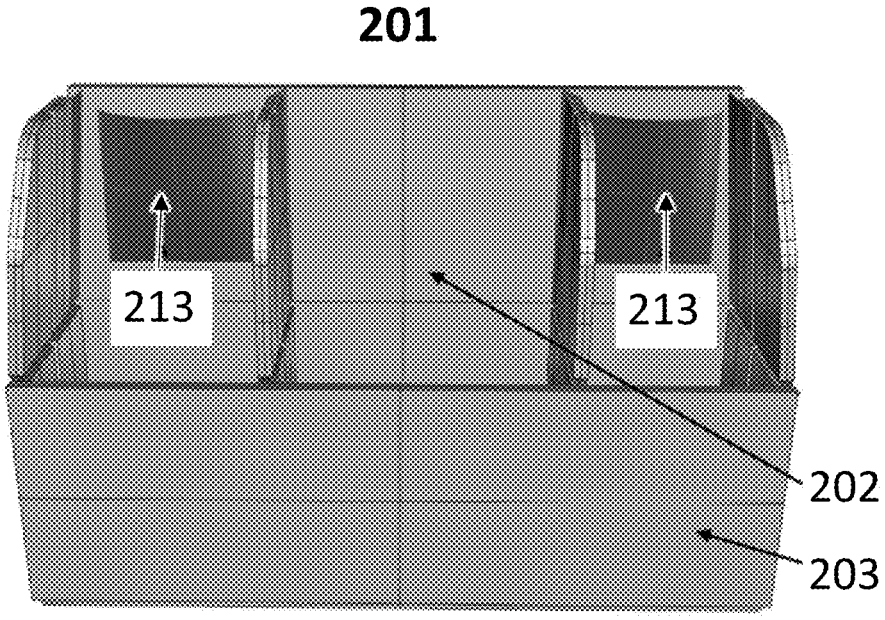
FIG. 2A is a front view of a second exemplary embodiment of a collapsible storage container.
Figure 2B:
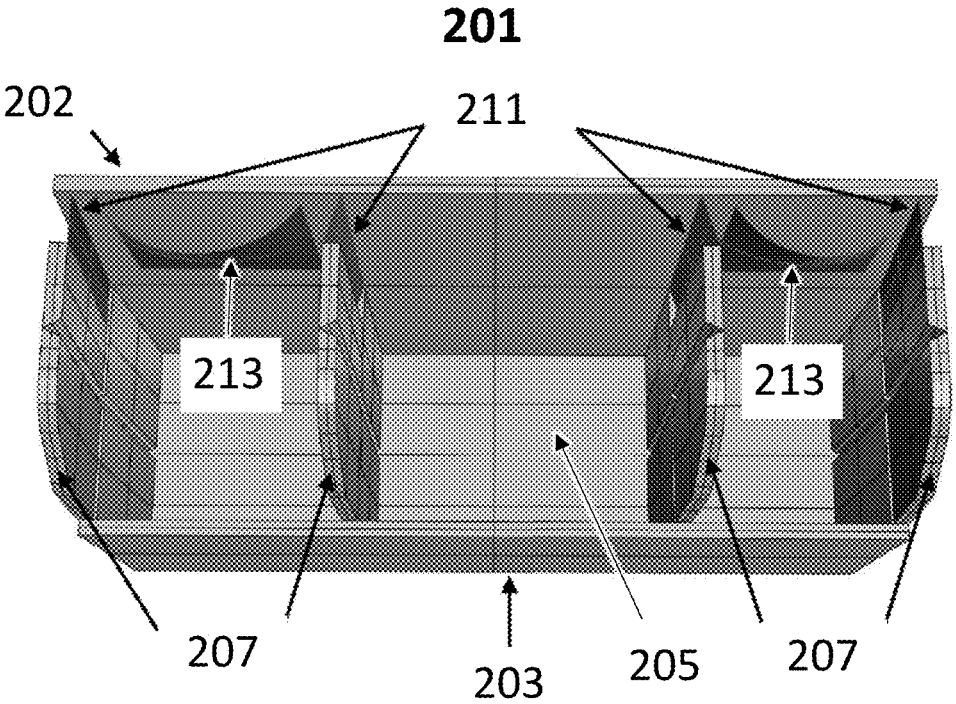
FIG. 2B is a top view of a second exemplary embodiment of the collapsible storage container.

Turning now to exemplary FIGS. 2A and 2B, FIG. 2A may show a front view of a second exemplary embodiment of a collapsible storage container, and FIG. 2B may show its top view. According to an exemplary embodiment, the storage container 201 may have one or more pockets 213 which may be attached on the back side 202, the front side 203, or elsewhere (for example, a pocket may be provided in a hanging bag suspended from the top side of the storage container, or may be coupled to one of the sidewalls, as may be desired) Such pockets may be used to, for example, provide easy access to thin items, such as memory cards or cleaning cloths, as may be desired. In an exemplary embodiment, the back side 202 and the front side 203 may be provided at different heights, for example, the height of the front side 203 may be lower than the back side 202, as desired. (It may also be contemplated that the height of the front side 203 and/or the back side 202 may not be uniform; for example, in an exemplary embodiment, the front side 203 may be curved so that the height of the front side 203 nearer the edges of the front side 203 is greater than or less than the height of the front side 203 nearer the center of the front side 203. Other variations of the front side 203 or back side 202, such as, for example, a variation in which the front side 203 and/or back side 202 is formed from multiple pieces, may also be understood as may be desired.) Also, as described above, the bottom side 205 and each divider 207 may be connected to the back side 202 and the front side 203 with a hinge. In an exemplary embodiment, an upper half of each divider 207 may be connected to the back side 202 and/or the front side 203 with an elastic hinge 211; for example, the upper half of each divider 207 may be connected to the back side 202 with an upper hinge formed from elastic that allows for stretching from side to side, which may provide greater flexibility and may allow camera parts or other articles to be more easily inserted into the storage container 201. In an exemplary embodiment, a lower half of each divider 207 may be connected to the back side 202 and/or the front side 203 with a fixed hinge, formed for example from fixed stitching, which may provide increased durability.

Figure 2C:
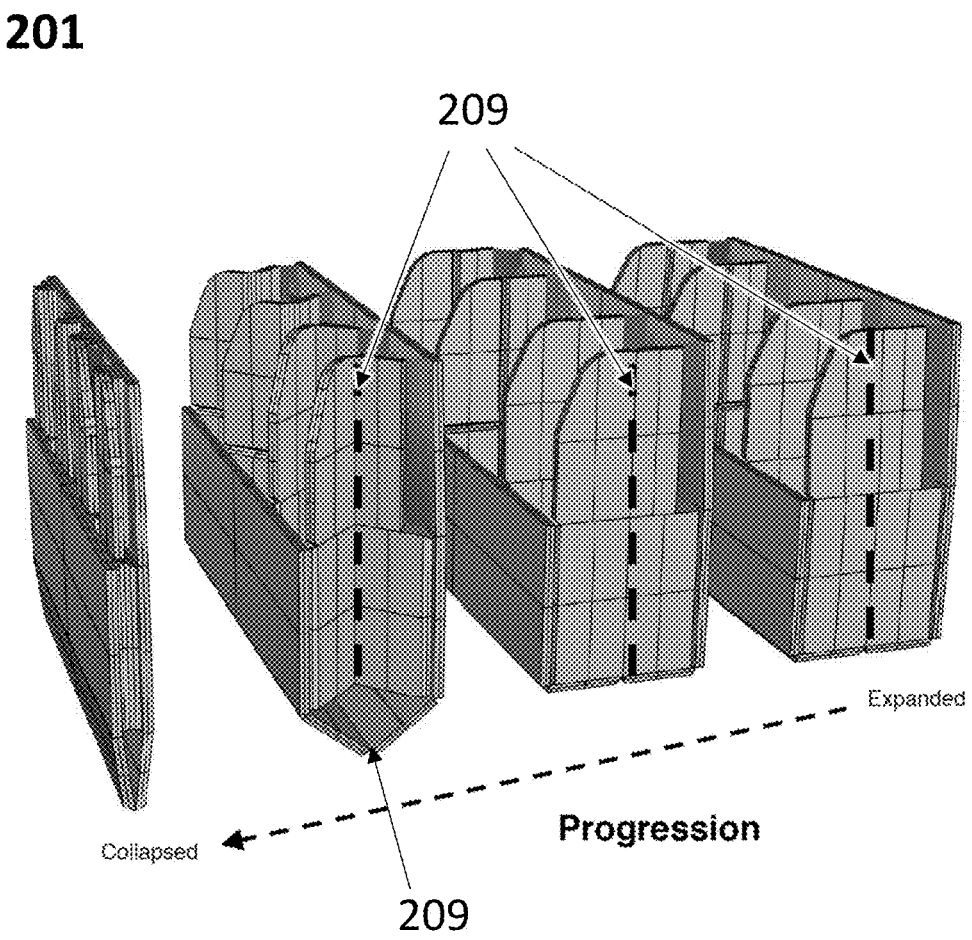
FIG. 2C is a side view of a second exemplary embodiment of the collapsible storage container which shows a progression of collapsing the container.
Figure 2D:
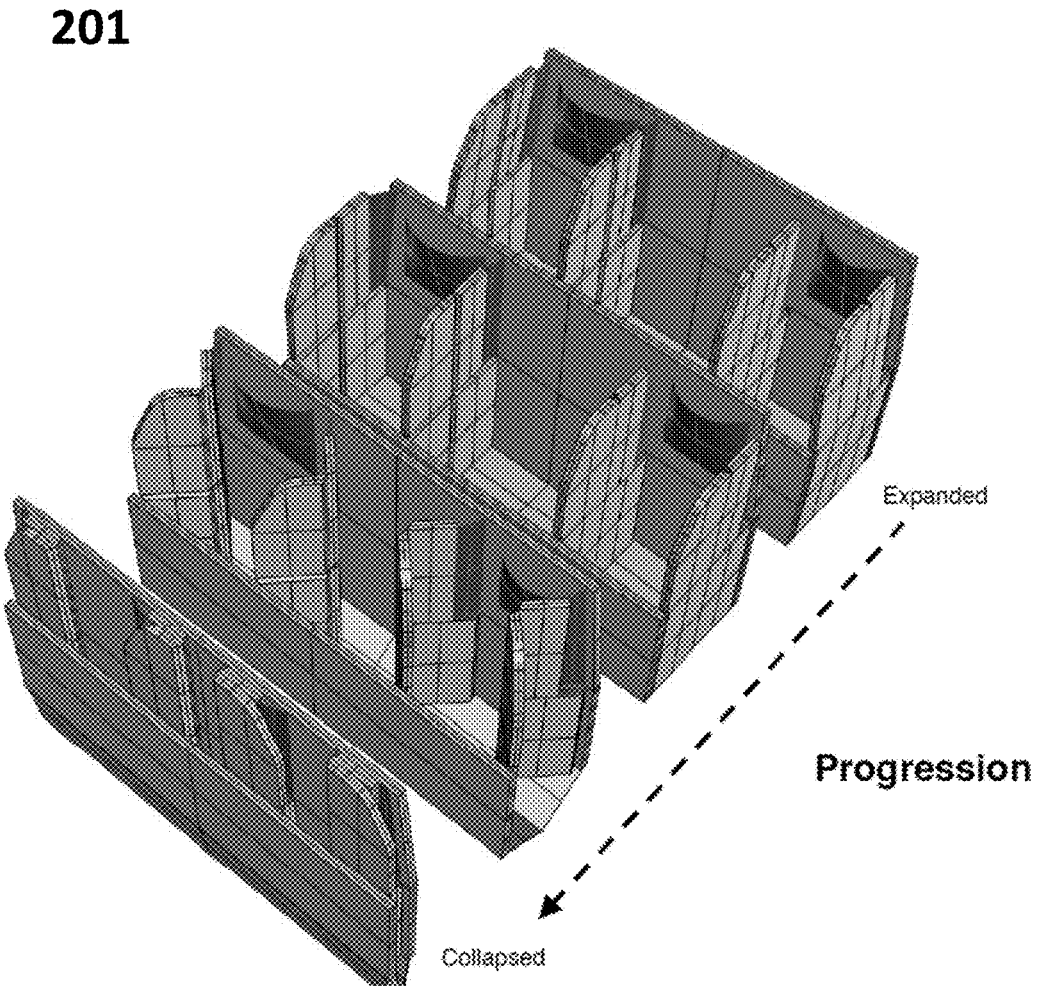
FIG. 2D is a top-side view of a second exemplary embodiment of the collapsible storage container which shows a progression of collapsing the container.
Figure 2E:
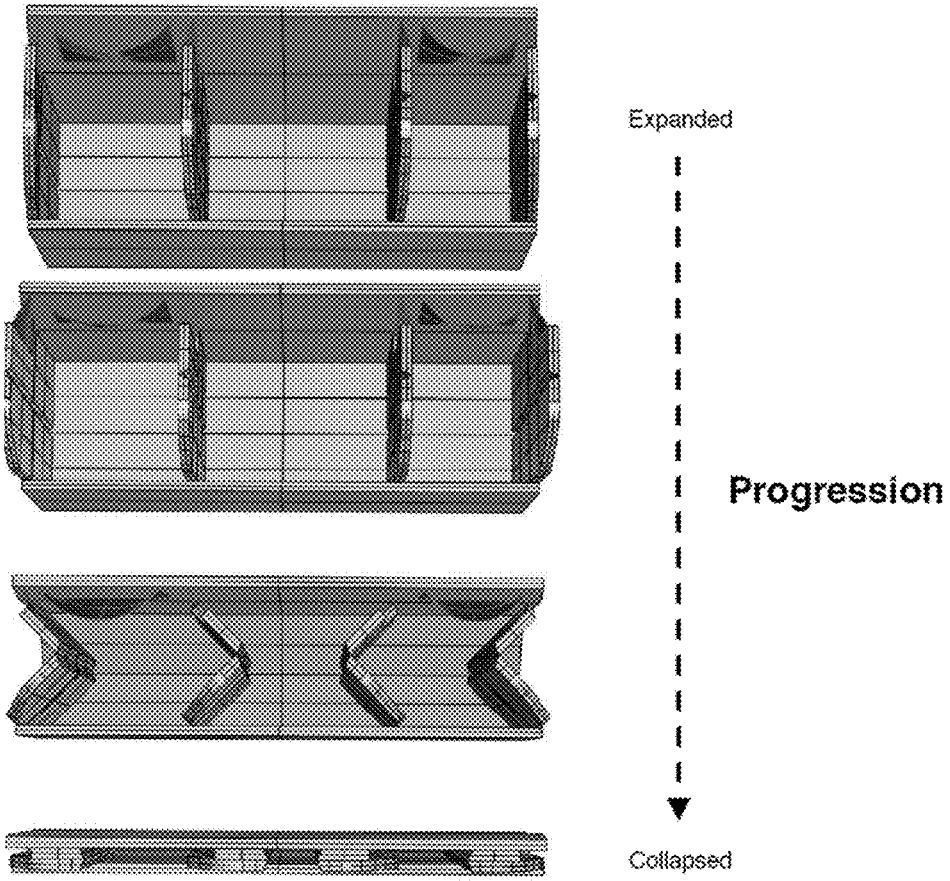
FIG. 2E is a top view of a second exemplary embodiment of the collapsible storage container which shows a progression of collapsing the container.

Turning now to exemplary FIGS. 2C, 2D and 2E, FIG. 2C may show a side view of a second embodiment of a collapsible storage container, FIG. 2D may show a top-side view of the collapsible storage container, and FIG. 2E may show a top view of the collapsible storage container, which describes a progression of the collapsible storage container as it is undergoing a process of being collapsed. According to an exemplary embodiment, as described above, the bottom side 205 piece and the pieces of divider 207 may be folded in one direction via the unidirectional grooved channel 209, with the dividers 207 being sandwiched between the front 203 and back sides 202.

Turning now to exemplary FIGS. 3A, 3B, 3C, 3D and 3G, FIG. 3A may show an exemplary embodiment of a collapsible storage container which is about to be inserted into a handbag. According to an exemplary embodiment, the storage container (101 or 201) may be inserted into a handbag 301 containing a camera 303 and camera lenses 304. Also, in an exemplary embodiment, a cover 302 of the handbag 301 may be closed after the storage container (101 or 201) is inserted in to the handbag 301 as shown in exemplary FIG. 3D.

Figure 3A:
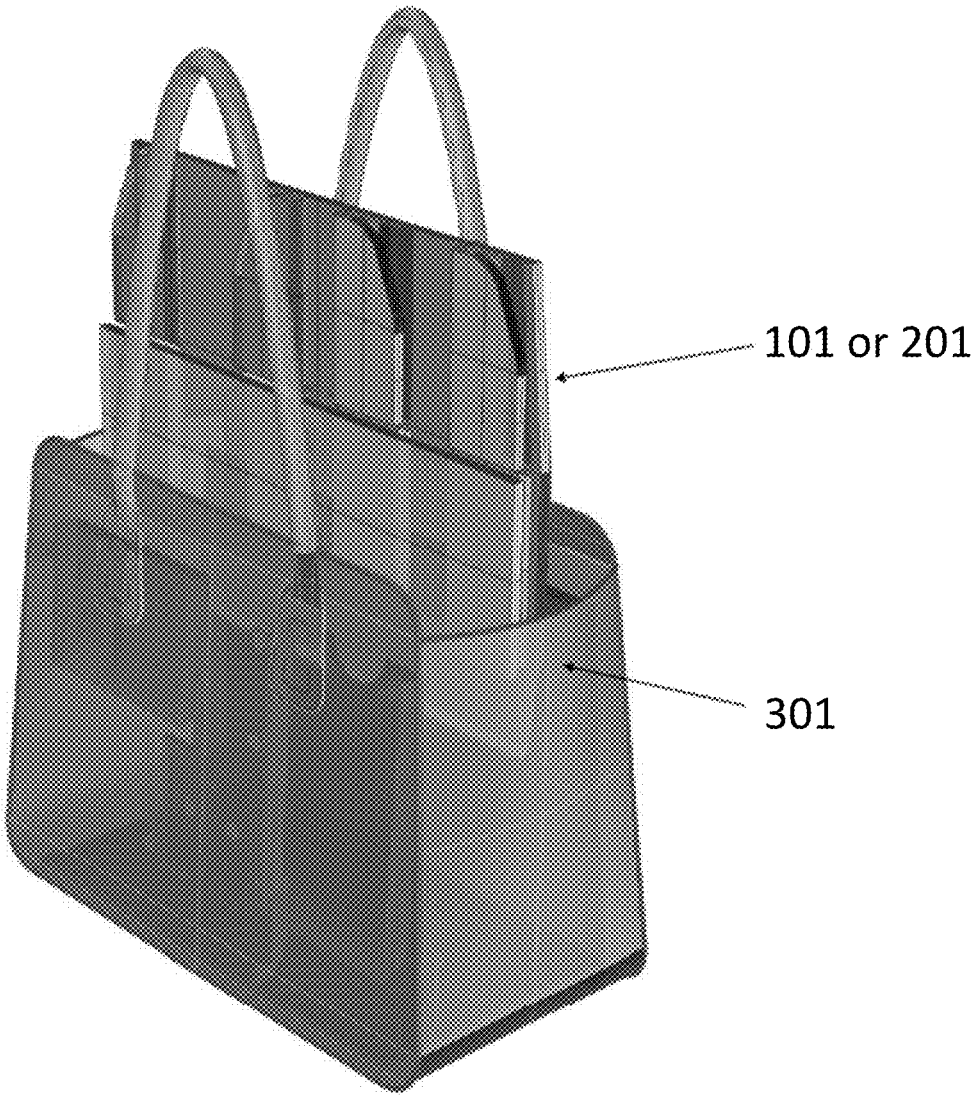
FIG. 3A shows an exemplary embodiment of a collapsible storage container which is about to be inserted into a handbag.
Figure 3B:
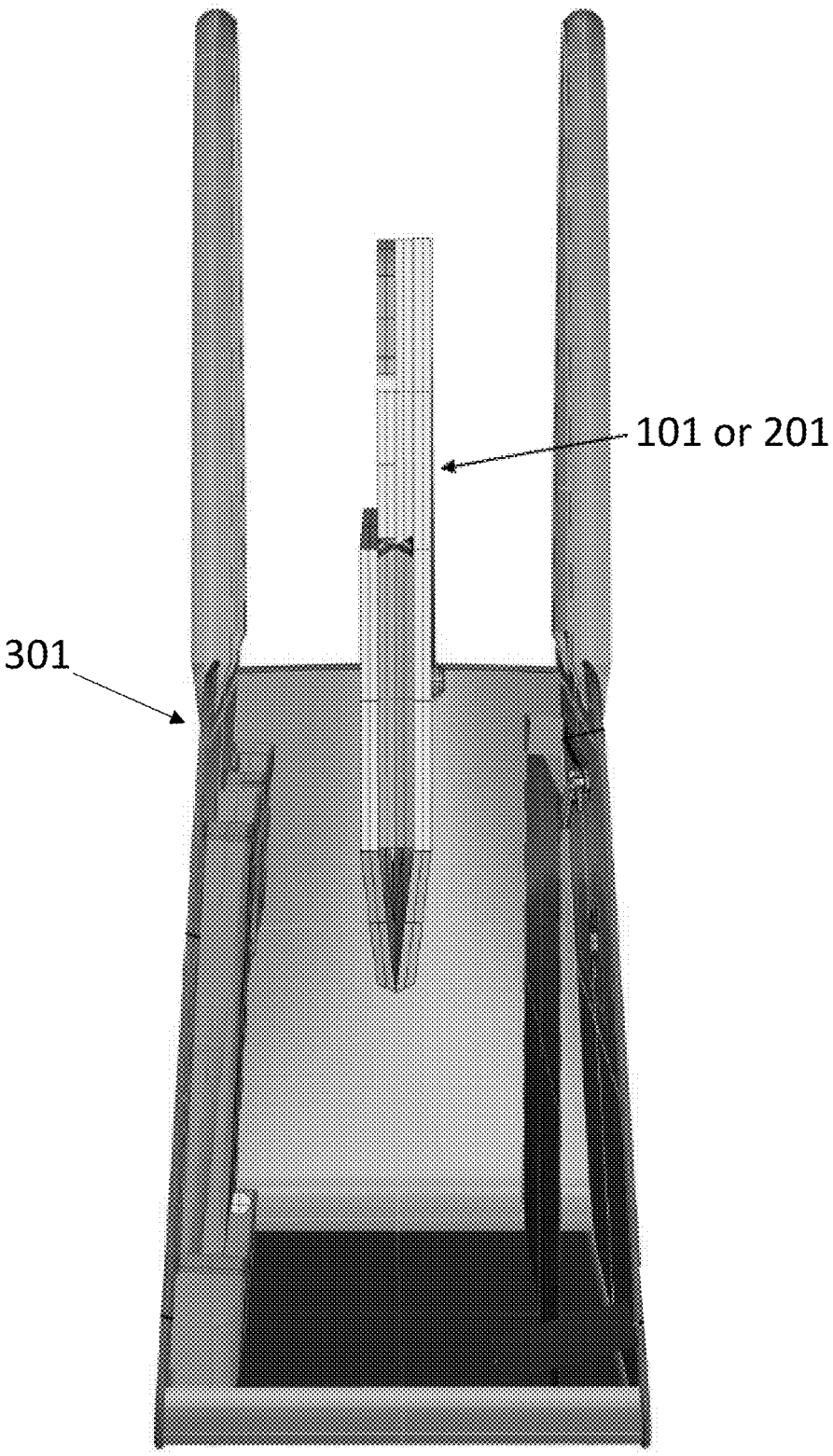
FIG. 3B shows, in a cutaway view, an exemplary embodiment of a collapsible storage container which is about to be inserted into a handbag.
Figure 3C:
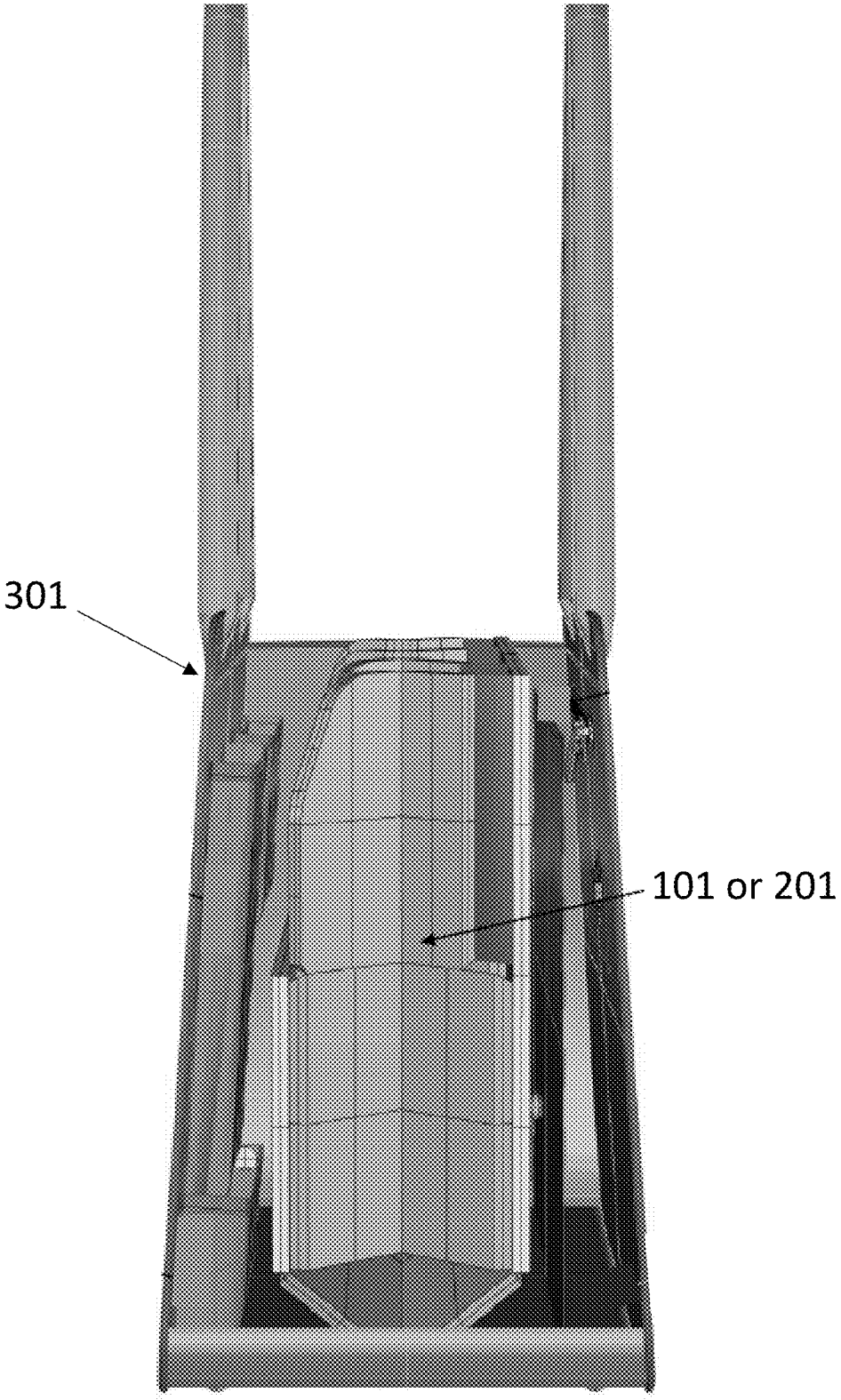
FIG. 3C shows, in a cutaway view, an exemplary embodiment of a collapsible storage container which is inserted into a handbag and partially expanded.
Figure 3D:
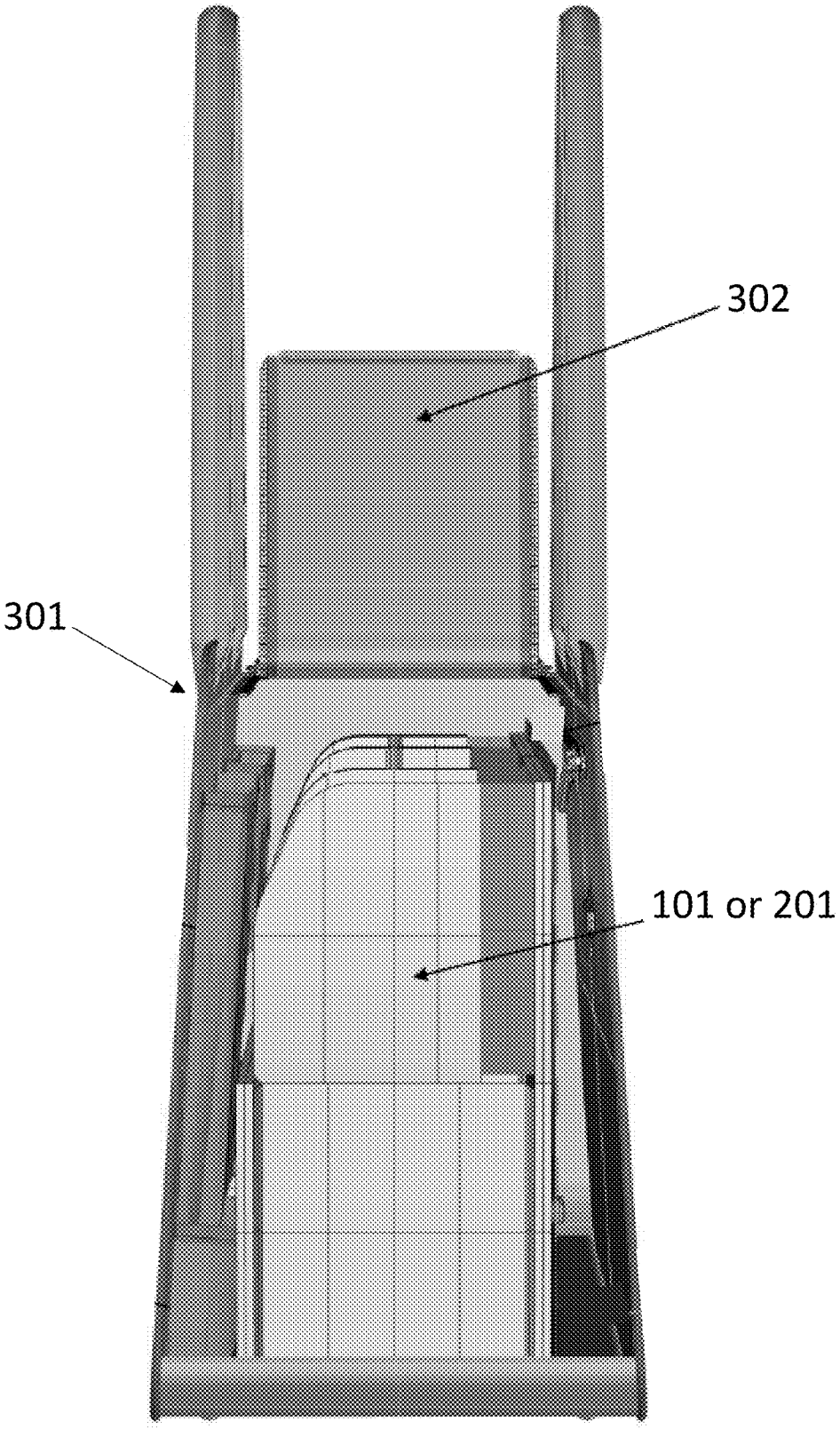
FIG. 3D shows, in a cutaway view, an exemplary embodiment of a collapsible storage container which is inserted into a handbag and expanded.
Figure 3E:
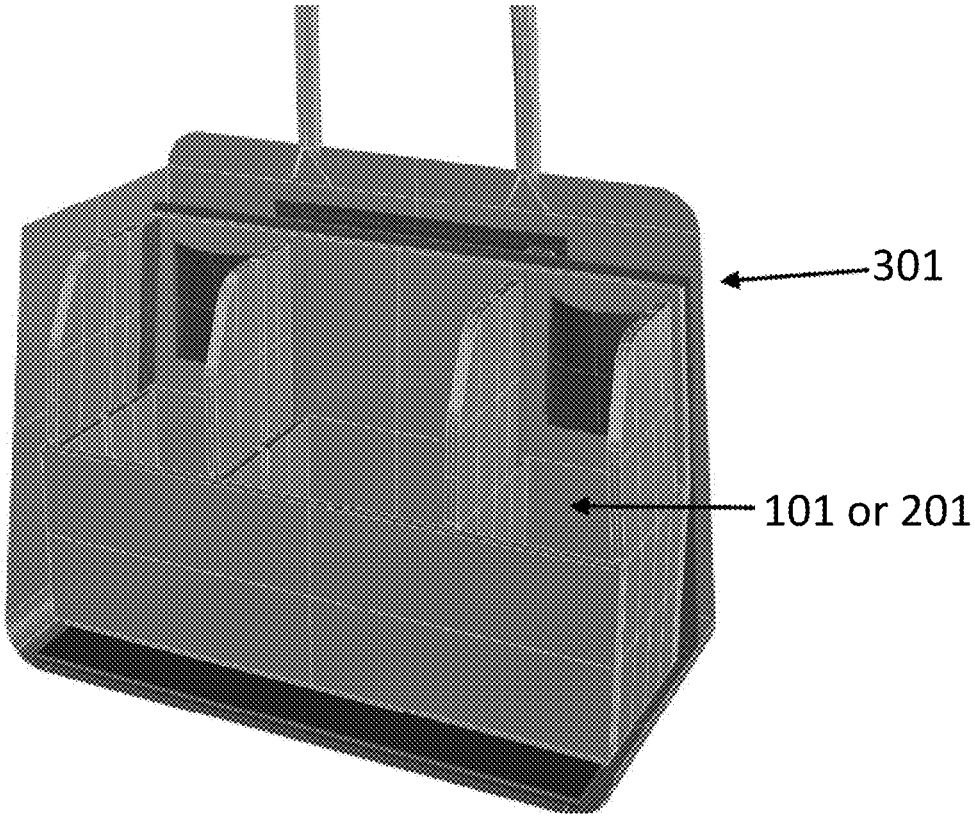
FIG. 3E shows, in a cutaway view, an exemplary embodiment of a collapsible storage container which is inserted into a handbag and expanded.
Figure 3F:
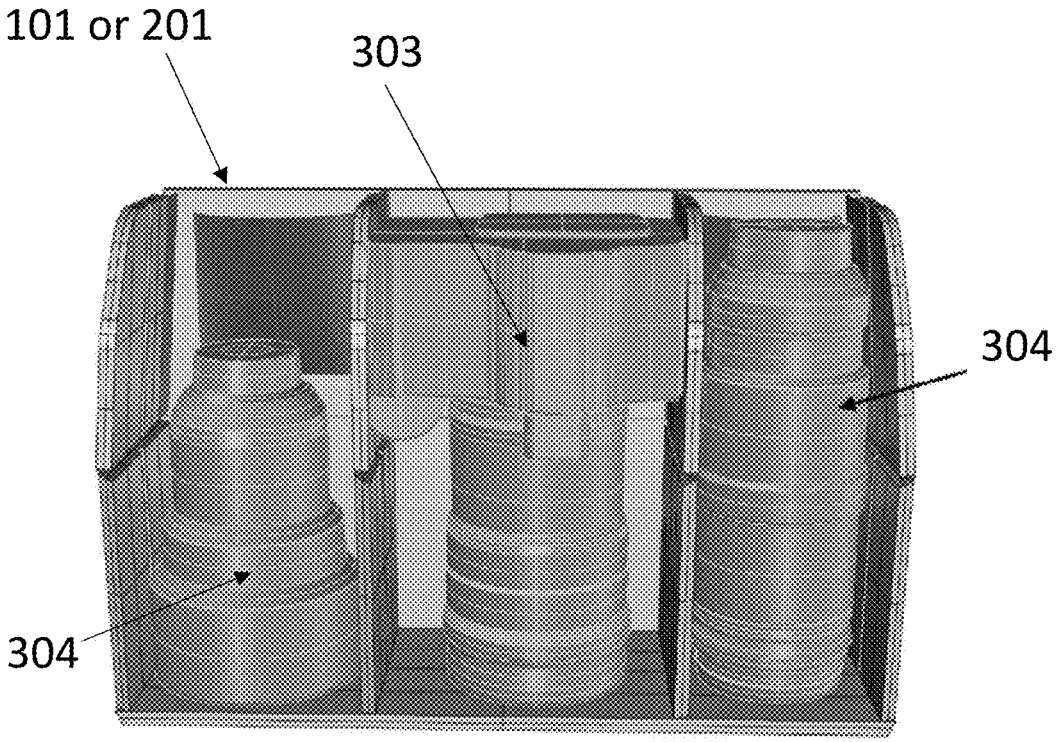
FIG. 3F shows, in a cutaway view, an exemplary embodiment of a collapsible storage container which is expanded and contains a camera and camera lens.
Figure 3G:
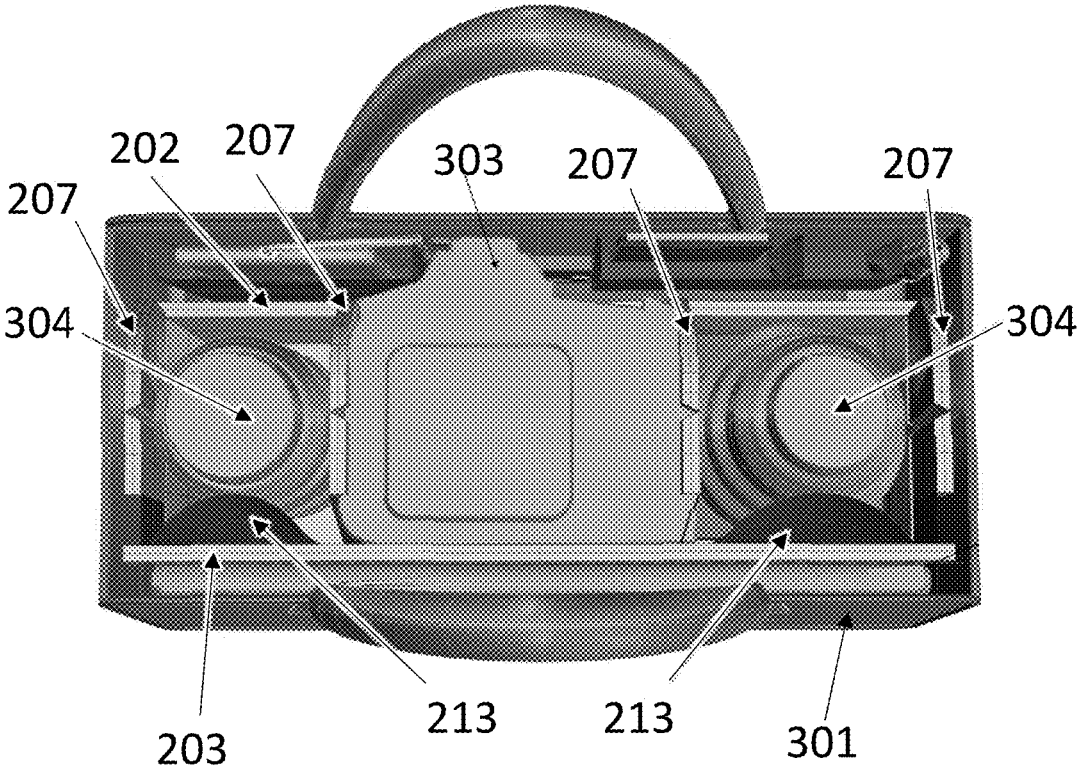
FIG. 3G shows, in a top view, an exemplary embodiment of a collapsible storage container which is inserted into a handbag and expanded containing a camera and camera lens.

For descriptive purposes, exemplary FIG. 3B may show, in a cutaway view, a collapsible storage container which is about to be inserted into a handbag, exemplary FIG. 3C may show, in a cutaway view, the collapsible storage container which is inserted into a handbag and partially expanded, exemplary FIG. 3D may show, in a cutaway view, the collapsible storage container which is inserted into a handbag and fully expanded, exemplary FIG. 3E may show, in a cutaway view, the collapsible storage container which is inserted into a handbag and expanded, exemplary FIG. 3F may show, in a cutaway view, the collapsible storage container which is expanded and contains the camera and the camera lens, and exemplary FIG. 3G may show, in a top view, the collapsible storage container which is inserted into a handbag and expanded containing the camera and the camera lens.

Figure 4A:
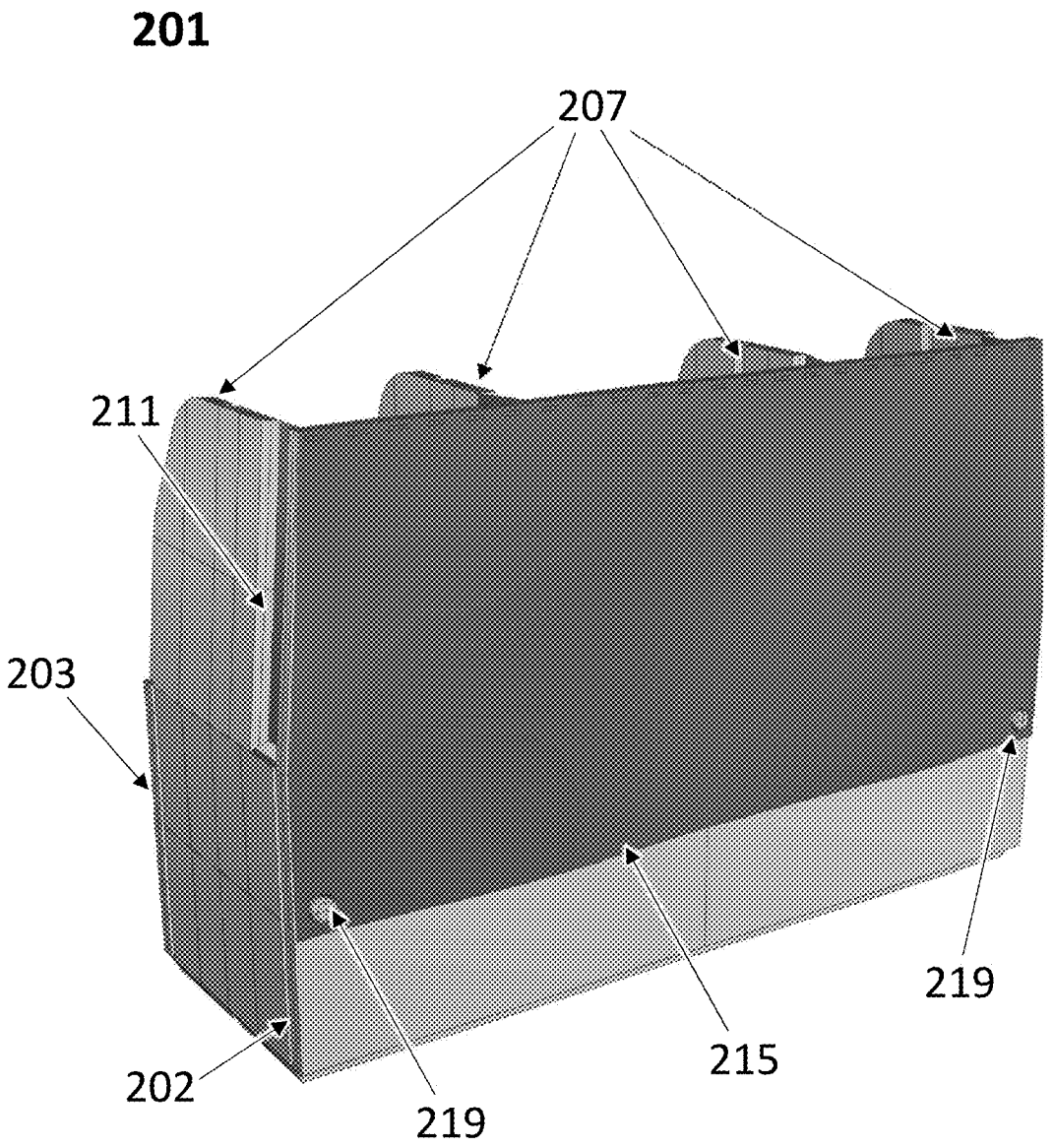
FIG. 4A shows, in a back view, an exemplary embodiment of a collapsible storage container which shows a flap-over cover in a retracted position.
Figure 4B:
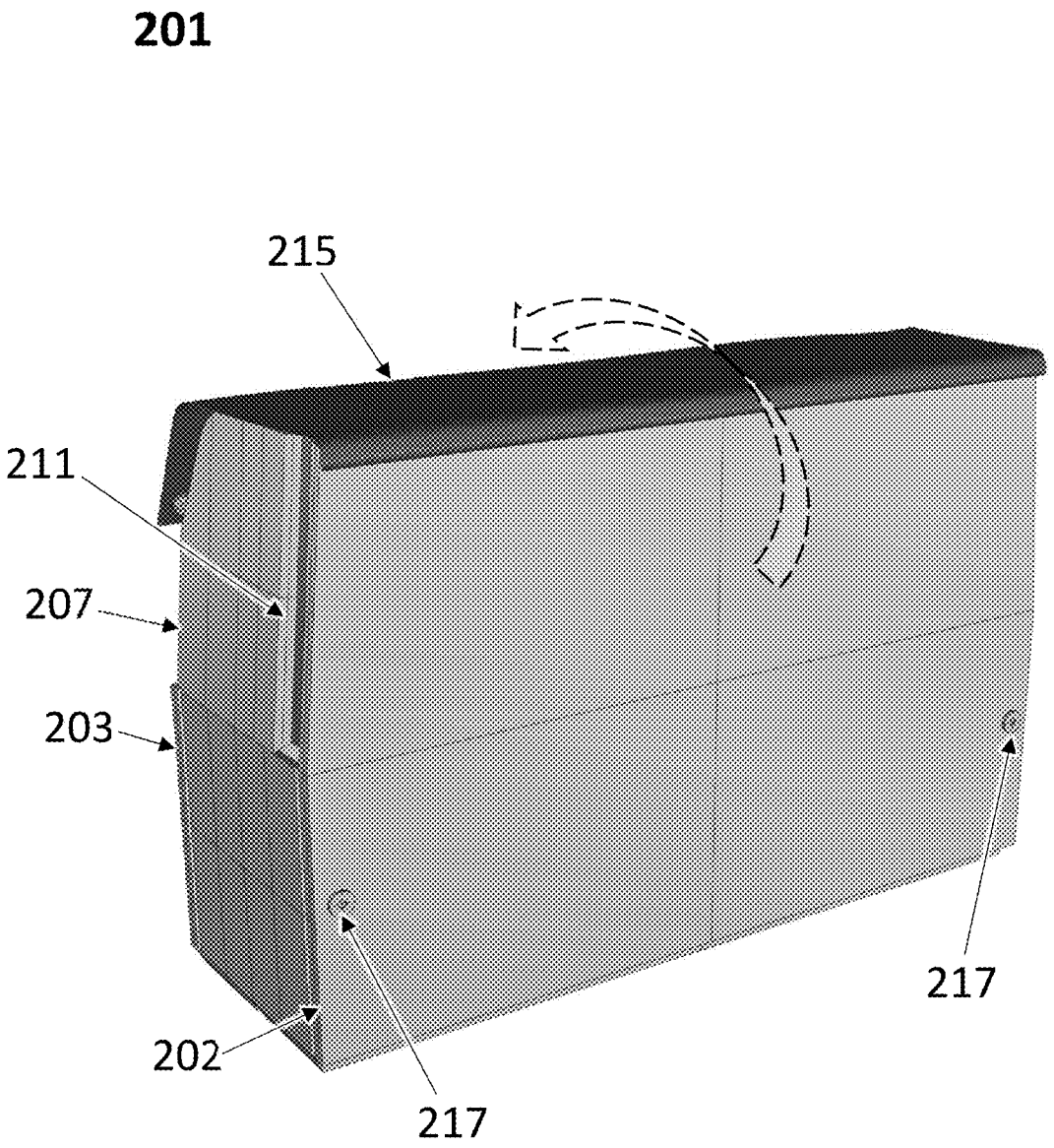
FIG. 4B shows, in a back view, an exemplary embodiment of a collapsible storage container which shows a flap-over cover in an extended position.
Figure 4C:
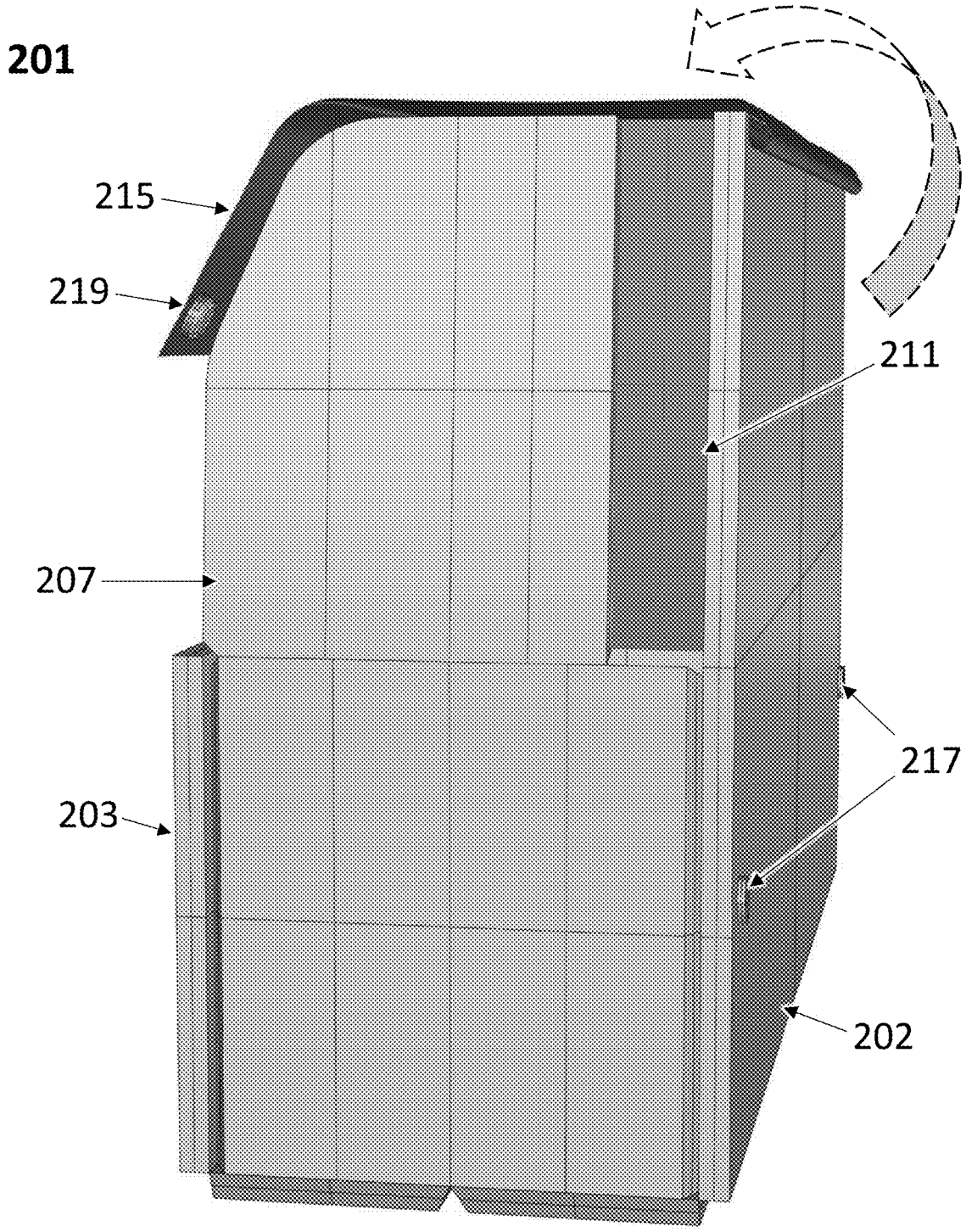
FIG. 4C shows, in a side view, an exemplary embodiment of a collapsible storage container which shows a flap-over cover in an extended position.
Figure 4D:
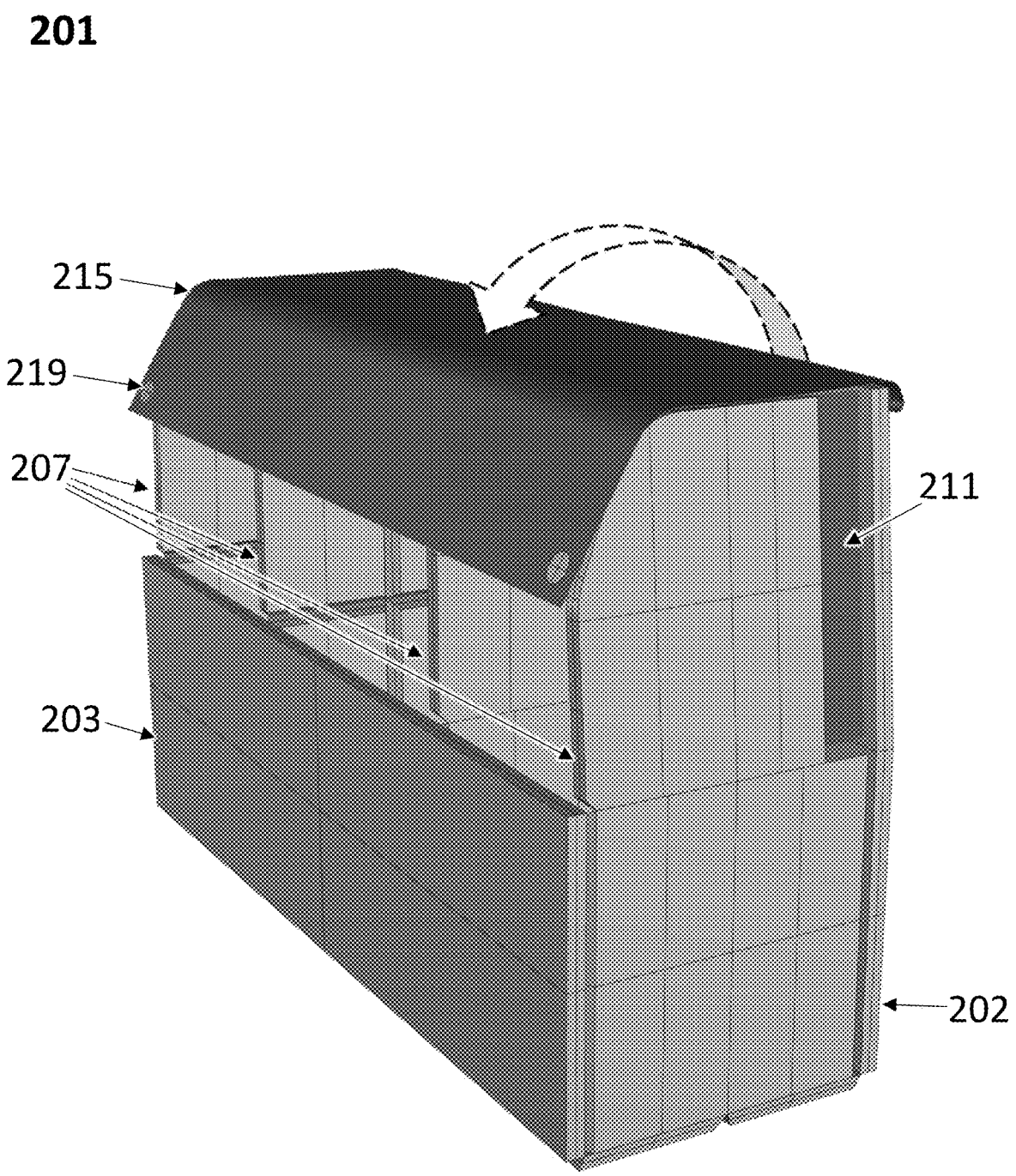
FIG. 4D shows, in a projection view, an exemplary embodiment of a collapsible storage container which shows a flap-over cover in an extended position.

Turning now to exemplary FIGS. 4A, 4B, 4C, and 4D, FIG. 4A may show, in a back view, an exemplary embodiment of a collapsible storage container 201 which shows a flap-over cover 215 in a retracted position. FIG. 4B may show, in a back view, an exemplary embodiment of a collapsible storage container 201 which shows a flap-over cover 215 in an extended position. FIG. 4C may show, in a side view, an exemplary embodiment of a collapsible storage container 201 which shows a flap-over cover 215 in an extended position. FIG. 4D may show, in a projection view, an exemplary embodiment of a collapsible storage container 201 which shows a flap-over cover 215 in an extended position. Such a cover 215 may be used in some exemplary embodiments to protect the contents of the collapsible storage container 201 (for example, if the handbag is intended to be open-topped) and may for example be waterproof or water-resistant, if desired. Such a cover 215 may alternatively be used to protect the contents from view, or to separate the contents from other contents of a handbag, or for any other purpose such as may be desired.

According to an exemplary embodiment, a flap-over cover 215 may be provided on a collapsible storage container 201, such as on a back side 202 of a collapsible storage container 201, or alternatively on a front side 203, on a divider 207, or elsewhere as may be desired. In some exemplary embodiments, a flap-over cover 215 may be substituted for another cover, such as, for example, a cover connected to neither side and configured to be removably coupled to both the front side 203 and the back side 202 of the collapsible storage container 201. (In other exemplary embodiments, a collapsible storage container 201 may be varied for another collapsible storage container, such as collapsible storage container 101 or another such container as may be desired.)

In an exemplary embodiment, a flap-over cover 215 may be provided with one or more couplings, such as one or more snap couplings 219, which may be disposed along an edge of the flap-over cover 215 or elsewhere. Other couplings, such as, for example, a zipper coupling, a magnetic coupling, a snap coupling strip (such as might be used in, for example, a picture hanging strip) or another coupling may be envisioned as may be desired.

In an exemplary embodiment, a snap coupling 219 or other coupling may be held in place when in an open position or when in an extended position by one or more snap bases 217 or other coupling bases which may be disposed on the collapsible storage container 201. For example, according to an exemplary embodiment, a plurality of snap bases 217 may be provided on the back side 202 of the collapsible storage container 201, and in order to extend the flap-over cover 215, a user may decouple the snap couplings 219 from the snap bases 217, allowing the flap-over cover 215 to be extended over the dividers 207. In an exemplary embodiment, one or more snap bases 217 may be provided on the front side 203 of the collapsible storage container 201 as well as the back side 202, or on another part of the collapsible storage container 201; for example, in an exemplary embodiment, one or more snap bases 217 may be provided on tabs that may be coupled to one or more of the dividers 207, which may be positioned in the same places as the snap couplings 219 when the flap-over cover 215 is extended over the dividers 207. Other solutions may be envisioned in exemplary embodiments where other connectors are provided; for example, in an exemplary embodiment, a front side 203 of a collapsible storage container 201 may have part of a zipper track, or may have one or more magnets, that may be used to couple to its equivalent connector on the flap-over cover 215.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A collapsible storage container, comprising:

a bottom side having a first unidirectional grooved channel disposed along the length of the bottom side, the first unidirectional grooved channel being disposed so as to allow the bottom side to be unidirectionally folded in half in a first direction;

a front side hinged to the bottom side along a front side bottom edge;

a back side hinged to the bottom side along a back side bottom edge; and a plurality of dividers disposed between the front side and the back side, wherein the plurality of dividers each extend downward to the front side bottom edge and back side bottom edge, wherein each of the plurality of dividers has a second unidirectional grooved channel disposed along the length of the divider, the second unidirectional grooved channel being disposed so as to allow the divider to be folded in half in a second direction, wherein the first direction is downward away from the plurality of dividers, and wherein a left divider forms a left side wall joining a left edge of the front side and a left edge of the back side and wherein a right divider forms a right side wall joining a right edge of the front side and a left edge of the back side.

2. The collapsible storage container of claim 1, wherein the collapsible storage container is configured to collapse flat such that the dividers are sandwiched between the front side and the back side.

3. The collapsible storage container of claim 1, wherein each of the plurality of dividers is connected to the back side and the front side with a hinge.

4. The collapsible storage container of claim 1, wherein the bottom side is connected to the back side and the front side with a hinge.

5. The collapsible storage container of claim 1, wherein an upper half of each of the plurality of dividers is connected to the back side and the front side with a hinge, and a lower half of each of the plurality of dividers is connected to the back side and the front side with a hinge.

6. The collapsible storage container of claim 1, wherein the front side is provided at a first height and the back side is provided at a second height greater than the first height, wherein an upper half of each of the plurality of dividers is connected to the back side with a hinge, and a lower half of each of the plurality of dividers is connected to the back side and the front side with a hinge.

7. The collapsible storage container of claim 1, wherein each of the bottom side, the front side, the back side and the plurality of dividers is constructed from a protective material.

8. The collapsible storage container of claim 7, wherein each of the bottom side, the front side, the back side and the plurality of dividers is covered in a soft material enclosing the protective material.

9. The collapsible storage container of claim 1, wherein the collapsible storage container is disposed in a handbag.

10. The collapsible storage container of claim 1, wherein the collapsible storage container is configured to retain a camera and one or more camera lenses.

11. The collapsible storage container of claim 1, wherein an inside of the storage container has at least one pocket which is attached on at least one of the back side and the front side.

12. The collapsible storage container of claim 1, further comprising a flap-over cover.

13. The collapsible storage container of claim 12, wherein the flap-over cover is provided on the back side and configured to extend over each of the plurality of dividers.

14. The collapsible storage container of claim 13, wherein the flap-over cover is provided along a top edge of the back side and configured to extend to an intermediate point disposed on an upper half of each of the plurality of dividers.

15. The collapsible storage container of claim 12, further comprising one or more connectors disposed on the flap-over cover and one or more connector bases disposed on the back side.

16. The collapsible storage container of claim 1, wherein each of the plurality of dividers is configured to fold in a direction of a lengthwise midpoint of the collapsible storage container.

17. A method of using a collapsible storage container, the collapsible storage container comprising a bottom side having a first unidirectional grooved channel disposed along the length of the bottom side, the first unidirectional grooved channel being disposed so as to allow the bottom side to be unidirectionally folded in half in a first direction, a front side hinged to the bottom side along a front side bottom edge, a back side hinged to the bottom side along a back side bottom edge, and a plurality of dividers disposed between the front side and the back side, wherein the plurality of dividers each extend downward to the front side bottom edge and back side bottom edge, wherein each of the plurality of dividers has a second unidirectional grooved channel disposed along the length of the divider, the second unidirectional grooved channel being disposed so as to allow the divider to be folded in half in a second direction, wherein the first direction is downward away from the plurality of dividers, and wherein a left divider forms a left side wall joining a left edge of the front side and a left edge of the back side and wherein a right divider forms a right side wall joining a right edge of the front side and a left edge of the back side; the method comprising:

folding the bottom side in half in a first direction by folding the bottom side along the first unidirectional grooved channel;

folding each of the plurality of dividers in half in a second direction by folding the divider along the second unidirectional grooved channel; and collapsing the collapsible storage container flat such that the dividers are sandwiched between the front side and the back side.

18. The method of claim 17, further comprising decoupling a flap-top cover from the back side of the collapsible storage container and extending the flap-top cover over each of the plurality of dividers.

19. The method of claim 17, further comprising inserting the collapsible storage container in a handbag and enclosing the collapsible storage container with a cover of the handbag.

* * * * *